US005352049A

United States Patent [19]

Shiraishi et al.

[11] Patent Number: 5,352,049

[45] Date of Patent: Oct. 4, 1994

[54] MEANS FOR HOLDING THERMAL TRANSFER PRINTING INK-SHEET IN CARTRIDGE

[75] Inventors: Mikio Shiraishi, Yokohama; Toshihiko Gotoh, Tokyo; Seiji Okunomiya, Katsuta; Hiroshi Shimizu, Yokohama, all of Japan

[73] Assignee: Hitachi, Ltd., Tokyo, Japan

[21] Appl. No.: 941,688

[22] Filed: Sep. 8, 1992

[30] Foreign Application Priority Data

Oct. 14, 1991 [JP] Japan ..... 3-264531

[51] Int. Cl.[5] ..... B41J 35/28

[52] U.S. Cl. ..... 400/208; 400/249; 400/708; 400/246

[58] Field of Search ..... 400/224.2, 246, 708, 400/208, 249, 703, 719

[56] References Cited

U.S. PATENT DOCUMENTS

| | | | |
|---|---|---|---|
| 4,970,531 | 11/1990 | Shimizu et al. | 400/208 |
| 5,005,998 | 4/1991 | Takanashi et al. | 400/208 |
| 5,079,565 | 1/1992 | Shimizu et al. | 400/208 |
| 5,290,114 | 3/1994 | Asami | 400/208 |

FOREIGN PATENT DOCUMENTS 95875 4/1990 Japan .

*Primary Examiner*—Edgar S. Burr
*Assistant Examiner*—John S. Hilten
*Attorney, Agent, or Firm*—Antonelli, Terry, Stout & Kraus

[57] ABSTRACT

An apparatus for holding a thermal transfer printing ink-sheet in a cartridge case and for indicating a characteristic of the ink-sheet, comprises an ink-sheet including an ink which is transferred from the ink-sheet by a heat energy, a shaft on which the ink-sheet is wound and which is mounted detachably and in a rotatable manner on the cartridge case, and an indicating member which is discrete in relation to the cartridge case, indicates the characteristic of the ink-sheet, is rotatable in relation to the shaft, and is connected to the shaft so that an integral combination of the indicating member and the shaft is kept on a replacement of the ink-sheet, and the indicating member and the shaft are separated simultaneously from the cartridge case on the replacement of the ink-sheet.

18 Claims, 7 Drawing Sheets

MEANS FOR HOLDING THERMAL TRANSFER PRINTING INK-SHEET IN CARTRIDGE

BACKGROUND OF THE INVENTION AND RELATED ART STATEMENT

The present invention relates to means for holding a thermal transfer printing ink-sheet in a cartridge and for indicating a characteristic of the ink-sheet.

A type or characteristic of a sheet-shaped medium received in a cartridge is indicated, for example, Japanese Industrial Standard K 7565 "Photograph—110 size cartridge—Position and dimension of Film exprodure index notch and Film discrimination notch".

A photographic sensitivity and type of the ink-sheet for the thermal transfer printing apparatus is indicated on an outside of a cassette which receives an ink-sheet storing roll shaft and a take-up shaft, in, for example, Japanese Patent Unexamined Publication No. 1-234269.

OBJECT AND SUMMARY OF THE INVENTION

An object of the present invention is to provide means for holding a thermal transfer printing ink-sheet in a cartridge case and for indicating a characteristic of the ink-sheet, in which means the characteristic of the ink-sheet to be used subsequently an be read out after a replacement of the ink sheet and the number of members which previously needed to be replaced and scrapped on the replacement of the ink-sheet is minimized.

According to the present invention, means for holding a thermal transfer printing ink-sheet in a cartridge case and for indicating a characteristic of the ink-sheet, comprises an ink-sheet including an ink which is transferred from the ink-sheet by a heat energy, with a shaft on which the ink-sheet is wound and which is mounted detachably and in a rotatable manner on the cartridge, and with an indicating member which is discrete with respect to the cartridge case, indicates the characteristic of the ink-sheet, is rotatable in relation to the shaft, and is connected to the shaft so that an integral combination of the indicating member and the shaft is maintained upon a replacement of the ink-sheet, and the indicating member and the shaft are separated simultaneously from the cartridge case upon replacement of the ink-sheet.

Since the characteristic of the ink-sheet is not indicated on the cartridge case, but is indicated on the indicating member connected to the shaft so that the indicating member is mounted on and separated from the cartridge case with the integral group of the indicating member and the shaft when the shaft is attached to and detached from the cartridge case on the replacement of the ink-sheet, according to the present invention, the indicating member is changed for a new indicating member on the replacement of the ink-sheet and a characteristic indicated on the new one can be read out after the replacement of the ink-sheet. And further, since only a combination of the shaft and the indicating member is exchanged on the replacement of the ink-sheet and the cartridge case does not need to be exchanged or scrapped on the replacement of the ink-sheet, the amount of members which need to be replaced and/or scrapped on the replacement of the ink-sheet is minimized.

DETAILED DESCRIPTION OF PREFERRED EMBODIMENTS

Figure 1:
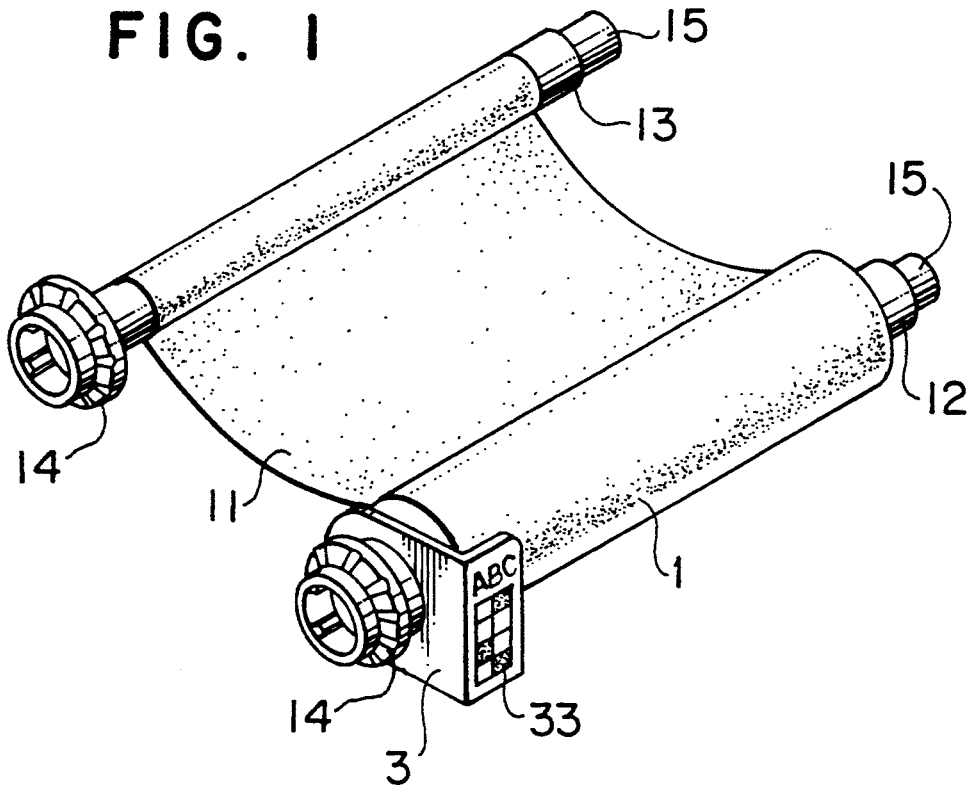
FIG. 1 is an oblique projection view of an embodiment of an ink-sheet roll assembly according to the present invention.
Figure 2:
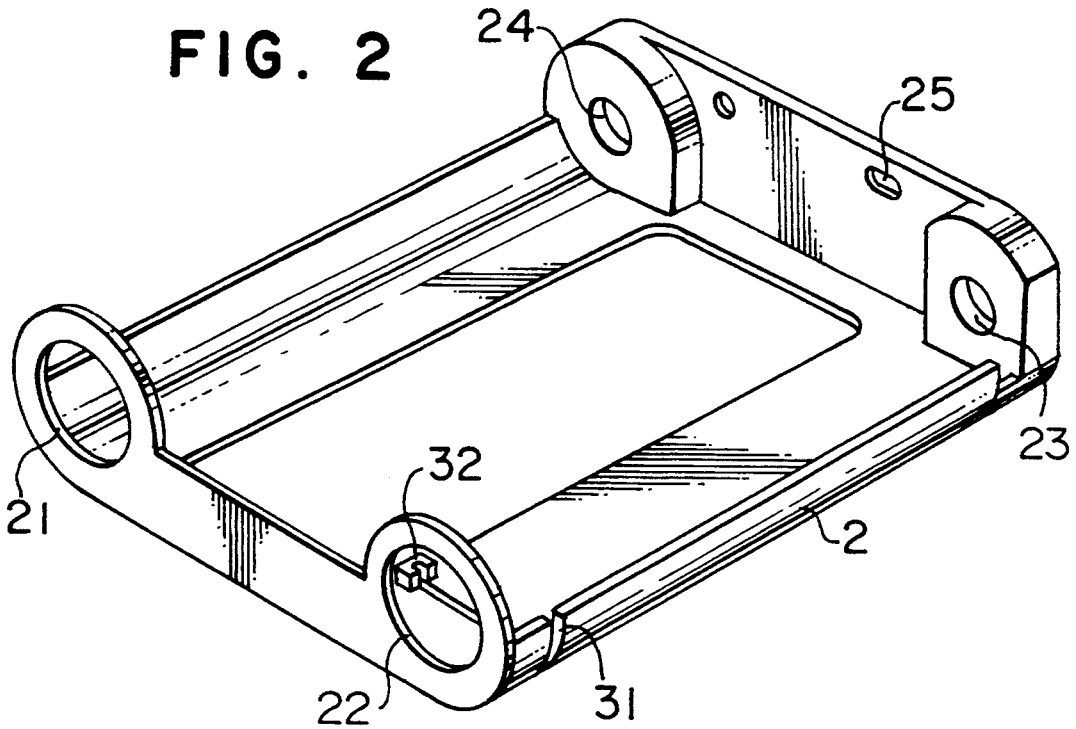
FIG. 2 is an oblique projection view of a cassette on which the embodiment of the ink-sheet roll assembly according to the present invention is set.

As shown in FIG. 1, an ink-sheet roll assembly 1 includes an ink-sheet storing shaft 12 on which an unused part of an ink-sheet 11 is wound, an ink-sheet take-up shaft 13 to which a forward end of the ink-sheet 11 is fixed to wind up a used part of the ink-sheet 11, and an indicating member 3 having an indication portion 33 thereon for indicating an characteristic and/or type of the ink-sheet 11. A longitudinal end of each of the ink-sheet storing shaft 12 and the ink-sheet take-up shaft 13 has a flange 14 which extends radially and whose diameter is larger than an inner diameter of the ink-sheet 11 wound on the ink-sheet storing shaft 12 and the ink-sheet take-up shaft 13, that is, an outer diameter of a part of each of the ink-sheet storing shaft 12 and the ink-sheet take-up shaft 13 for receiving the ink-sheet 11 thereon. Another longitudinal end of each of the ink-sheet storing shaft 12 and the ink-sheet take-up shaft 13 has a supported forward end 15 whose diameter is smaller than the inner diameter of the ink-sheet 11 wound on the ink-sheet storing shaft 12 and the ink-sheet take-up shaft 13, that is, the outer diameter of the part of each of the ink-sheet storing shaft 12 and the ink-sheet take-up shaft 13 for receiving the ink-sheet 11 thereon. The indicating member 3 is arranged between the flange 14 on the ink-sheet storing shaft 12 and the unused part of the ink-sheet 11 wound on the ink-sheet storing shaft 12: The indicating member 3 has a hole through which the indicating member 3 is supported or mounted on the ink-sheet storing shaft 12 in a rotatable manner and whose diameter is larger than the outer diameter of the part of the ink-sheet storing shaft 12 for receiving the ink-sheet 11 thereon and smaller than an outer diameter of the flange 14. And further, the diameter of the hole of the indicating member 3 is smaller than an outer diameter of the ink-sheet 11, before the ink-sheet 11 is not substantially wound up from the ink-sheet storing shaft 12 toward the ink-sheet take-up shaft 13 or is used by a significant length. Therefore, the indicating member 3 cannot be separated from the ink-sheet storing shaft 12 before all of the ink-sheet 11 is wound up from the ink-sheet storing shaft 12 into the ink-sheet take-up shaft 13 and the ink-sheet storing shaft 12 is detached from a cartridge case 2 (FIG. 2). The ink-sheet storing shaft 12 and the indicating member 3 can be reused respectively, after they are detached from the cartridge.

Figure 3:
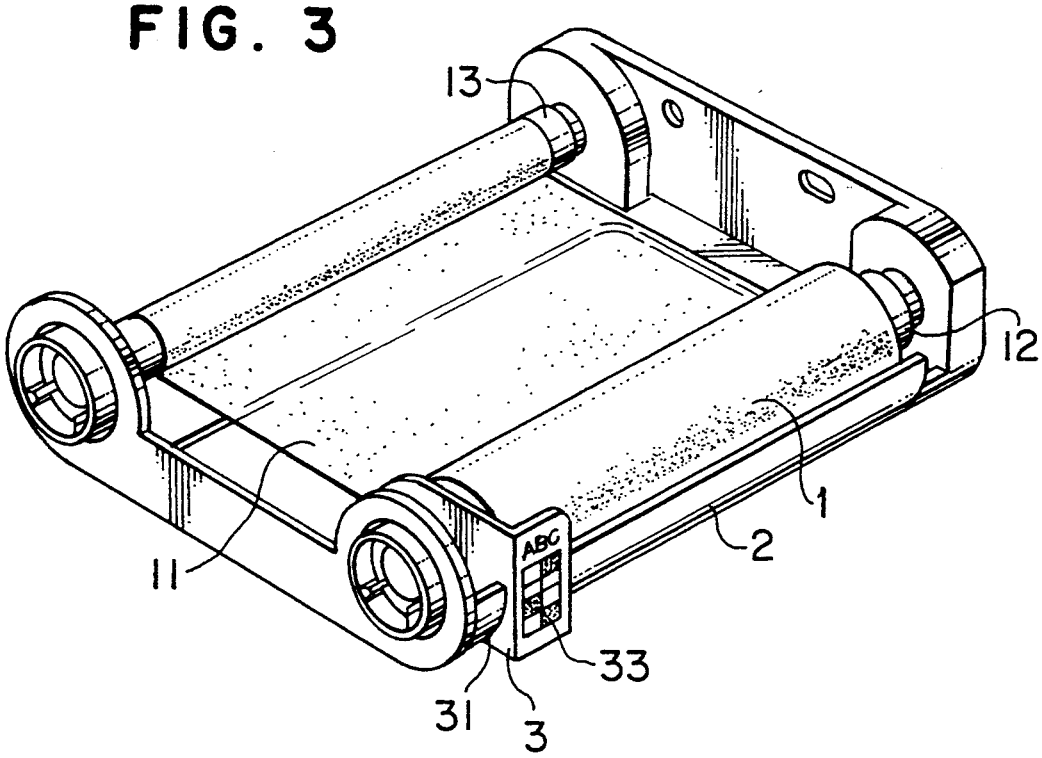
FIG. 3 is an oblique projection view of a combination of the cassette and the ink-sheet roll assembly according to the present invention.
Figure 4:
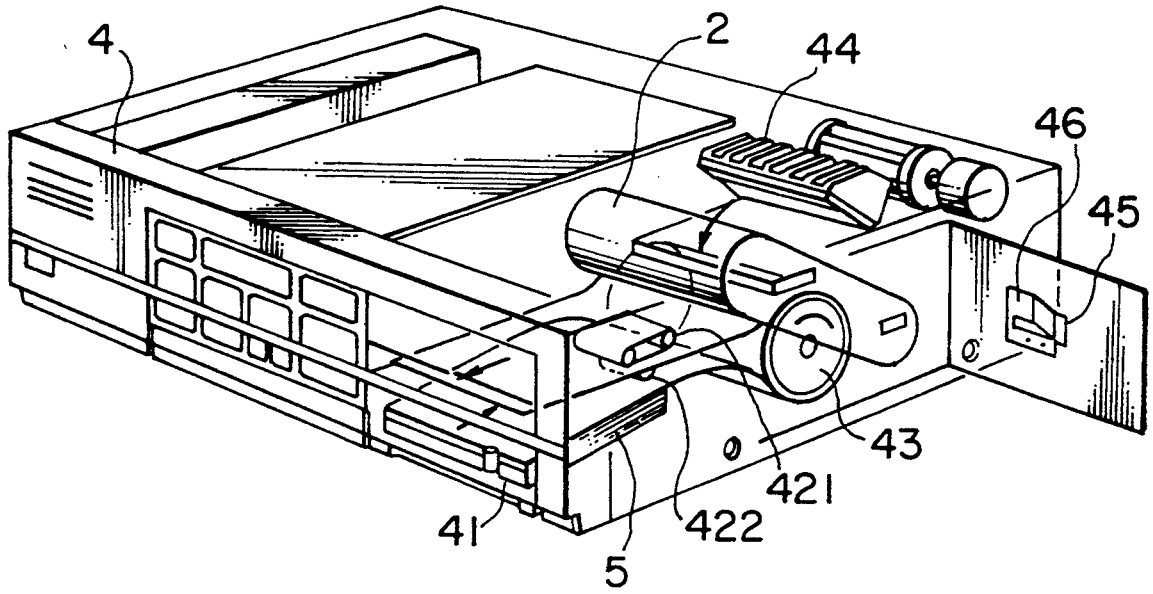
FIG. 4 is a schematic oblique projection view of a thermal transfer printing apparatus to which the cartridge case and the ink-sheet roll assembly according to the present invention are applied.
Figure 5:
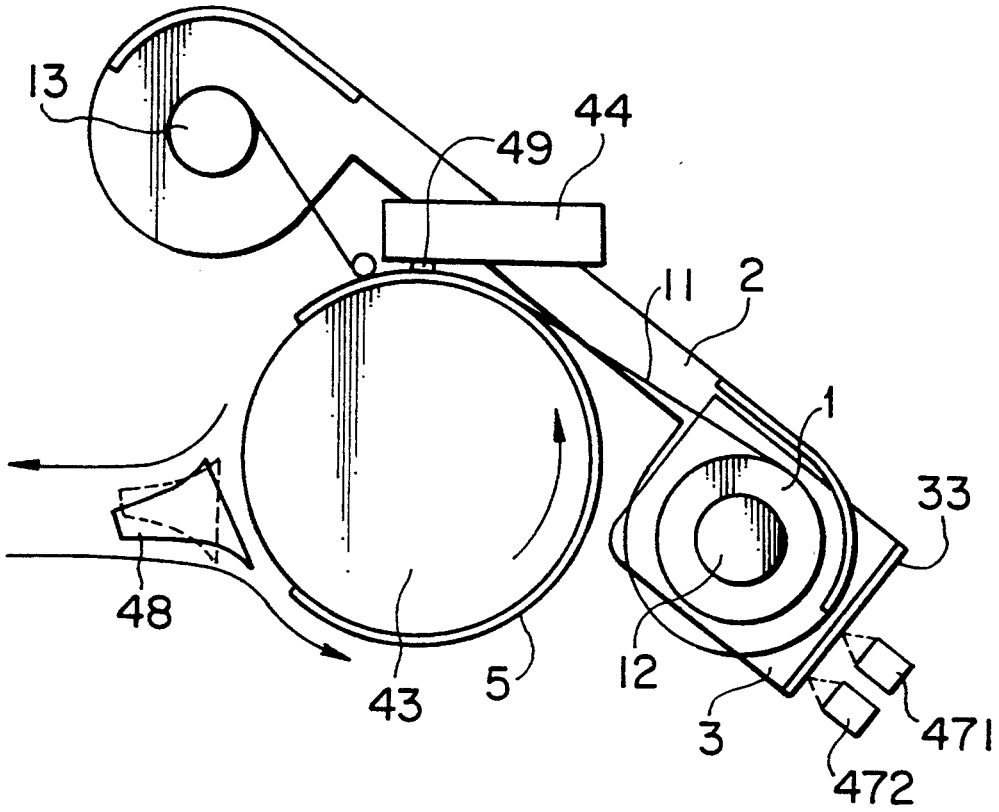
FIG. 5 is a schematic view of an embodiment of a thermal transfer printing mechanism including the cartridge case and the ink-sheet roll assembly according to the present invention.

As shown in FIGS. 2 and 3, the cartridge case or cassette case 2 includes a flange support hole 21 for supporting the flange 14 on the ink-sheet take-up shaft 13, a flange support hole 22 for supporting the flange 14 on the ink-sheet storing shaft 12, a forward end support hole 24 for supporting the forward end 15 of the ink sheet take up shaft 13, a forward end support hole 23 for supporting the forward end 15 of the ink-sheet storing shaft 12, and indicating member support grooves 31 and 32 receiving the indicating member 3 for preventing a motion of the indicating member 3 in a longitudinal direction of the ink-sheet storing shaft 12. A part of the cartridge 2 surrounding the flange support holes 21 and 22 have an elesticity so that distances between the flange support holes 21 and 22 and the forward end support holes 23 and 24 are expanded when the ink-sheet storing shaft 12 and the ink-sheet take-up shaft 13 are inserted and set therebetween. Spring members (not shown) of elastic plate or the like are received respectively in the forward end support holes 23 and 24 to urge the ink-sheet storing shaft 12 and the ink-sheet take-up shaft 13 from the forward end support holes 23 and 24 toward the flange support holes 21 and 22 so that the ink-sheet storing shaft 12 and the ink-sheet take-up shaft 13 are prevented from being freely released from the cartridge 2. The indication portion 33 on the indicating member 3 extends to the outside of the cartridge case 2 so that the characteristic and/or type of the ink-sheet 11 is indicated at the outside of the cartridge case 2 and is read out by a thermal transfer printing apparatus 4, as shown in FIG. 4, into which the cartridge case 2 is applied. If the indication portion 33 has a pattern composed, for example, of words and/or color of ink, which can be understood by people, the characteristic and/or type of the ink-sheet 11 can be readily ascertained.

As shown in FIG. 4, in the thermal transfer printing apparatus 4, an image and/or pattern is recorded on a work sheet 5, and subsequently the work sheet 5 is discharged from the thermal transfer printing apparatus 4. The work sheets 5 which are unused are received in a work sheet tray 41 and are removed in order therefrom onto a drum 43 by a work sheet supply roller 42 after a printing operation starts. Subsequently, the removal work sheet 5 is fed to a thermal head 44 in a thermal transfer printing portion according to a rotation of the drum 43. In the thermal transfer printing portion, the thermal head 44 is pressed against and contacted with the work sheet 5 by a pressing device (not shown) through the ink-sheet 11 in the cartridge case 2 so that the thermal transfer printing is carried out on the work sheet 5. For example, four-hundred eighty heating elements arranged along a straight line extending perpendicularly to a work sheet feed direction on the thermal head 44 are controlled to generate respective appropriate heat energy for forming a desired print pattern. That is, the heat-energy from each of the heating elements heats the ink-sheet 11 so that a thermally fusible or vaporizable ink arranged on a side of ink-sheet which contacts with the work sheet 5 is melted or vaporized to be transferred from the ink-sheet 11 to the work sheet 5. If an amount or rate of heat energy generated from each of the heating elements is controlled according to the desired print pattern, an amount or rate of the fused or vaporized ink on each of the heating elements is charged to control a shade of color on the printed pattern on the work sheet 5.

After the thermal transfer printing is carried out on the heating elements arranged along the straight line on the thermal heat 44, the work sheet 5 is fed in the work sheet feed direction by a length corresponding substantially to a effective heating width of the heating elements in the work sheet feed direction so that the thermal transfer printing is carried out in two dimensions for the desired print pattern. If a desired color is necessary in the thermal transfer printing, the ink-sheet 11 includes a plurality of parts in a ink-sheet feed direction or a longitudinal direction of the ink-sheet 11, colors of inks arranged respectively on the parts are made different from each other, and the colors of inks different from each other are transferred in order on a predetermined portion on the work sheet 5 so that a multilayer thermal transfer printing for the desired color is carried out.

When a cartridge lid 45 of the thermal transfer printing apparatus 4 is closed after the cartridge case 2 is inserted into the thermal transfer printing apparatus 4, the cartridge case 2 is pressed through a cartridge pressing spring 46 to be fixed into the thermal transfer printing apparatus 4.

A total amount of the ink-sheet 11 stored on the ink-sheet roll assembly is sufficient for carrying out the thermal transfer printing for example, for printing one hundred images. The cartridge case including the ink-sheet 11 2 may be replaced by another cartridge case before all of the ink-sheet 11 is fed from the ink-sheet storing shaft 12 to the ink-sheet take-up shaft 13. For example, if a black-and-white printing is necessary after a multicolor printing, the cartridge case 2 including the ink-sheet 11 for the multicolor printing is removed from the thermal transfer printing apparatus 4, and the cartridge case 2 including the ink-sheet 11 for the black-and-white printing is set in the thermal transfer printing apparatus 4.

An optical characteristic reader 47 mounted on the thermal transfer printing apparatus 4 reads out the characteristic or type of the ink-sheet 11 or the ink in the ink-sheet 11 from the indication portion 33 on the indicating member 3 by detecting a refrection of light from the indication portion 33. On the basis of the read-out characteristic or type of the ink-sheet 11, printing conditions, for example, a heating condition of the thermal head 44 and a feed speed of the drum 43 are adjusted to maintain a good thermal transfer printing on the work sheet 5.

Figure 6:
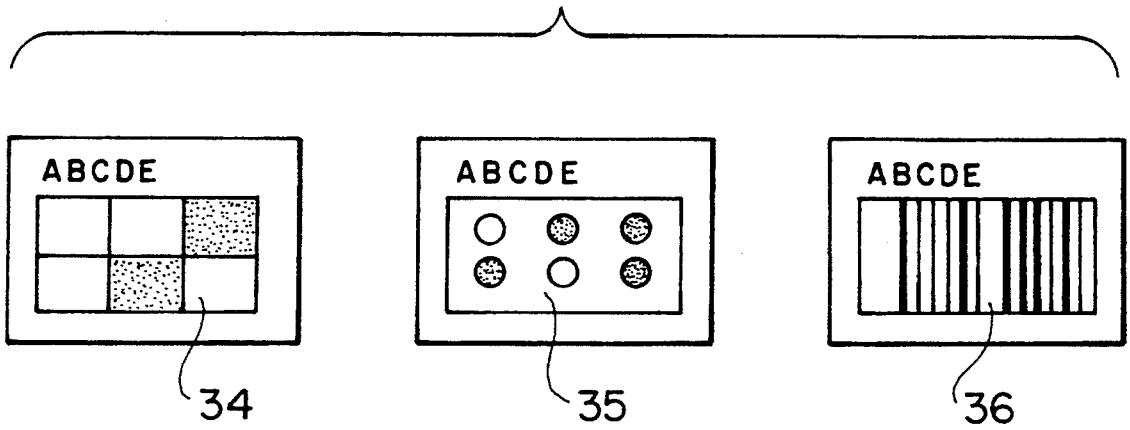
FIG. 6 is a schematic view of a variation of characteristic indication pattern.

As shown in FIG. 6, the pattern for indicating the characteristic or type of the ink-sheet 11 on the indication portion 33 may be modified. In a black-and-white blocks pattern 34 including six blocks on which either a black color or a white color is printed, for example, $2^6$ variations of the characteristic or type of the ink-sheet 11 can be indicated by the printed colors in the six blocks. In a blocked shape pattern 35, shapes, for example, holes, in blocks indicate the variations of the characteristic or kind of the ink-sheet 11. A bar pattern or bar code 36 may indicate the variations of the characteristic or kind of the ink-sheet 11. A word and/or color which indicates the characteristic or type of the ink-sheet 11 and can be understood by people may be arranged on the indication portion 33.

The indicating member 3 extends to a radially outside of a maximum outer periphery of the ink-sheet 11 wound on the ink-sheet storing shaft 12 so that the indicating member 3 contacts with a floor or the ground when the ink-sheet roll assembly 1 drops thereto. Therefore, a friction between the indicating member 3 and the floor or ground and a friction between the indicating member 3 and the ink-sheet storing shaft 12 prevent the ink-sheet storing shaft 12 from rolling on the floor or ground.

Figure 7:
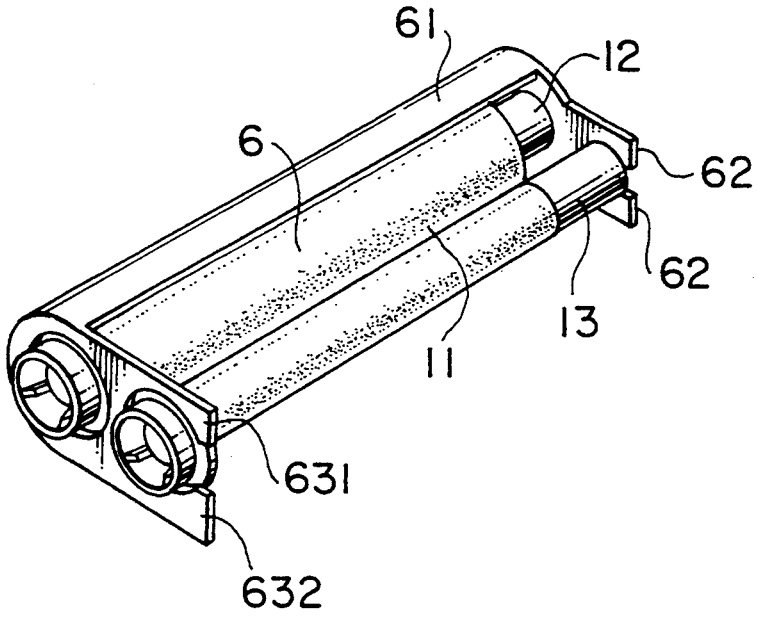
FIG. 7 is an oblique projection view of another embodiment of an ink-sheet roll assembly according to the present invention.
Figure 8:
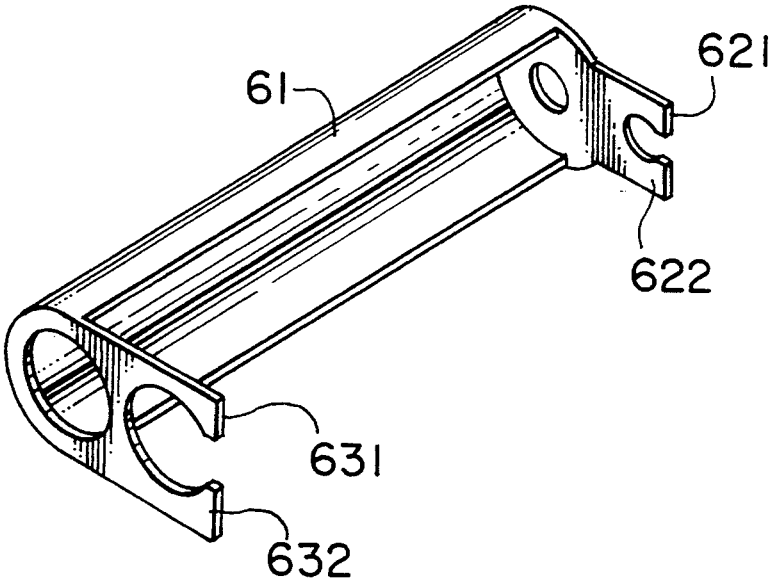
FIG. 8 is an oblique projection view of a sub-cassette included by the embodiment of FIG. 7.
Figure 9:
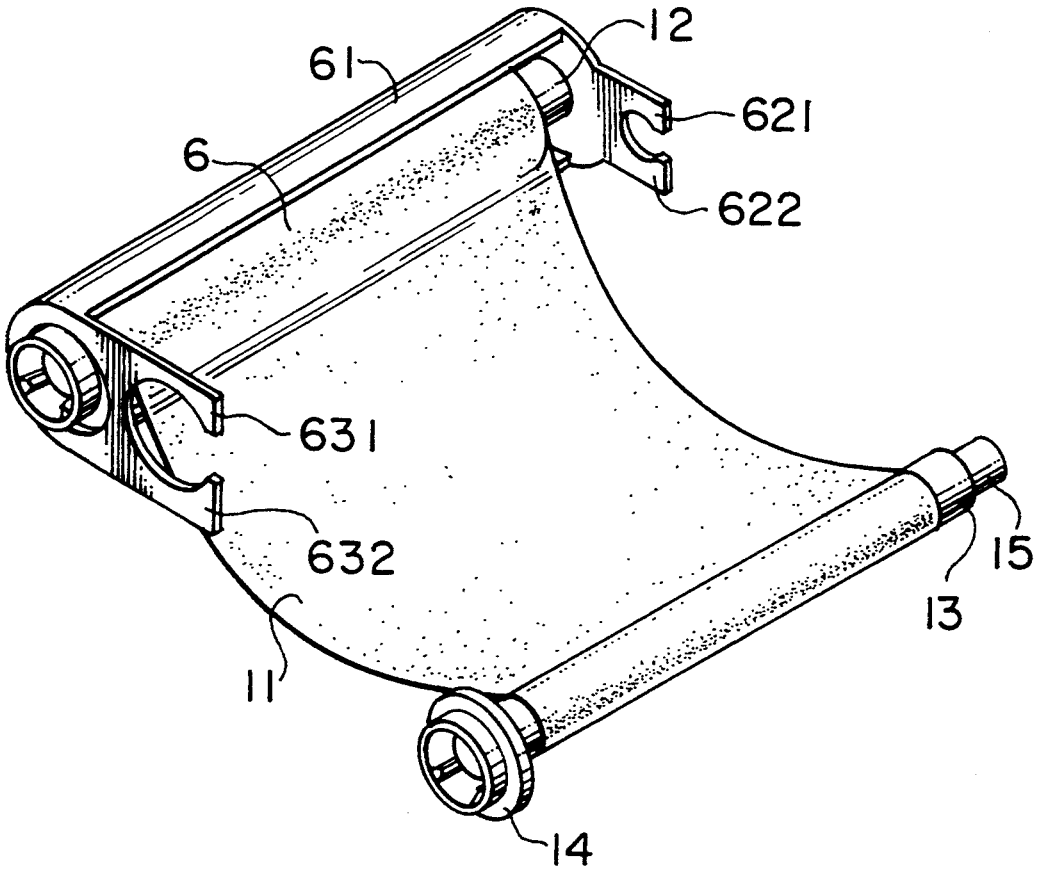
FIG. 9 is an oblique projection view of a combination of the sub-cartridge case and an ink-sheet storing roll, and an ink-sheet take-up roll in the embodiment of FIG. 7.

As shown in FIGS. 7 and 8, another ink-sheet roll assembly 6 includes the ink-sheet storing shaft 12 on which the unused part of the ink-sheet 11 is wound, the ink-sheet take-up shaft 13, and an ink-sheet carriage 61 for holding the ink-sheet storing shaft 12 and the ink-sheet take-up shaft 13. The indication portion 33 for indicating the characteristic or kind of the ink-sheet 11 is arranged on a reverse side (not shown) of the ink-sheet carriage 61. The ink-sheet take-up shaft 13 is held in the ink-sheet carriage 61 by forward and fitting portions 621 and 622 and flange fitting portion 631 and 632. The forward end fitting portions 621 and 622 and the flange fitting portions 631 and 632 are made of an elastic material, for example, a plastic resin so that the ink-sheet take-up shaft 13 is detached from the ink-sheet carriage 61 when a distance between the forward end fitting portions 621 and 622 and the flange fitting portions 631 and 632 is expanded. Since the forward end of the ink-sheet 11 is fixed to the ink-sheet take-up shaft 13 before the ink-sheet take-up shaft 13 and the ink-sheet storing shaft 12 are mounted on the ink-sheet carriage 61, the ink-sheet 11 is taken up from the ink-sheet storing shaft 12 when the ink-sheet take-up shaft 13 is detached from the ink-sheet carriage 61, as shown in FIG. 9.

Figure 10:
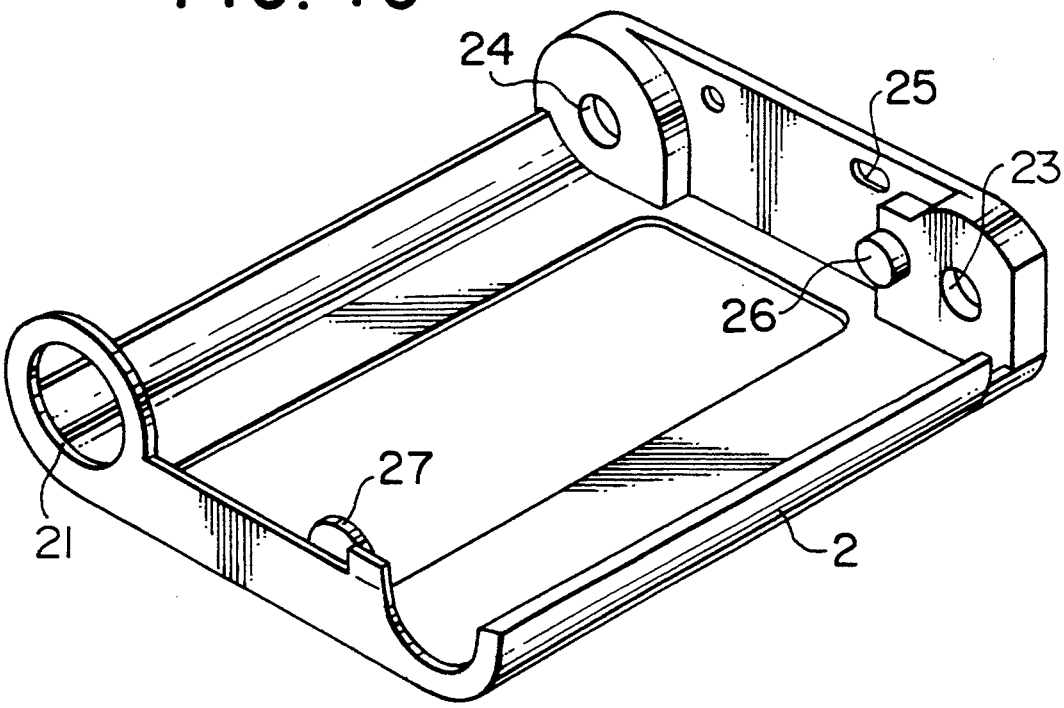
FIG. 10 is an oblique projection view of a cartridge case on which the embodiment of FIG. 7 is set.
Figure 11:
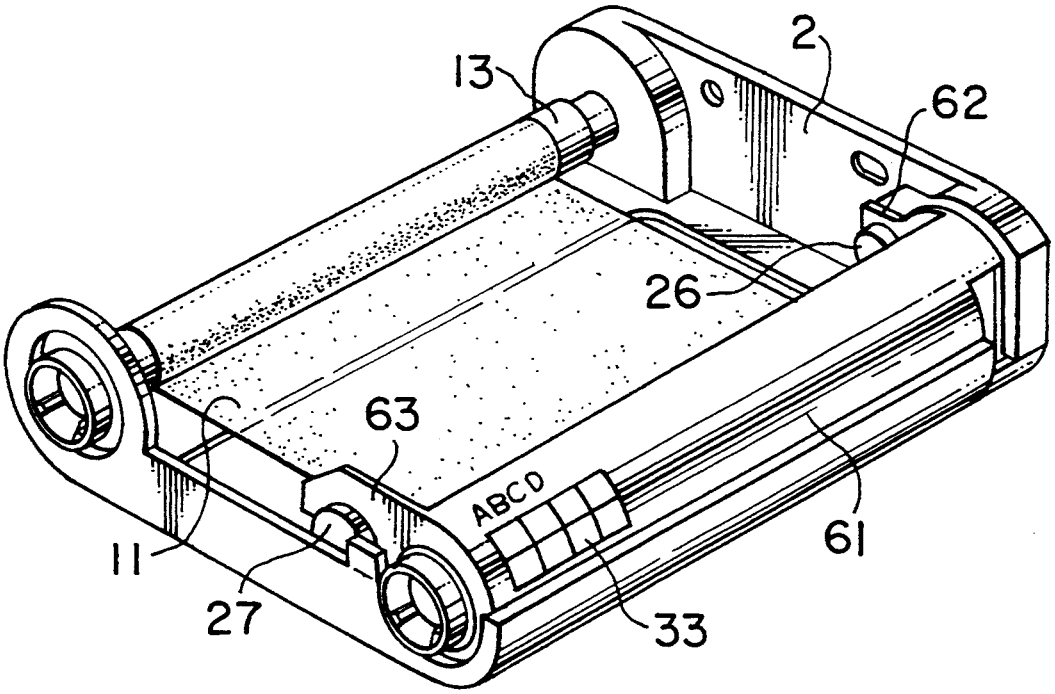
FIG. 11 is an oblique projection view of a combination of the cartridge case of FIG. 10 and the ink-sheet roll assembly of FIG. 7.

After the ink-sheet take-up shaft 13 detached from the ink-sheet carriage 61 and the ink-sheet storing shaft 12 received in the ink-sheet carriage 61 are mounted on the cartridge case 2 as shown in FIG. 11, the thermal transfer printing is carried out. A used part of the ink-sheet 11 is wound up on the ink-sheet take-up shaft 13. After all of the ink-sheet 11 is taken up from the ink-sheet storing shaft 12 to the ink-sheet take-up shaft 13, the ink-sheet take-up shaft 13 is attached again to the ink-sheet carriage 61 and the used ink-sheet 11 is scrapped. Since the ink-sheet take-up shaft 13 having the used ink-sheet 11 thereon is held in the ink-sheet carriage 61, the used ink-sheet 11 is not taken up from the ink-sheet take-up shaft 13. The carriage case 2 used for the ink-sheet roll assembly 6, as shown in FIG. 10, has a forward end projection 26 and a flange projection 27 onto which the forward end fitting portions 621 and 622 and the flange fitting portions 631 and 632 are fitted respectively to fix detachably the ink-sheet carriage 61 with the ink-sheet storing shaft 12 to the cartridge case 2. The ink-sheet take-up shaft 13 detached from the ink-sheet carriage 61 is fixed to the cartridge case 2 through the forward end support hole 24 and the flange support hole 21, as shown in FIG. 2. The indication portion 33 for indicating the characteristic or type of the ink-sheet 11 received in the ink-sheet carriage 61 is arranged on the ink-sheet carriage 61 combined with the cartridge case 2.

Figure 12:
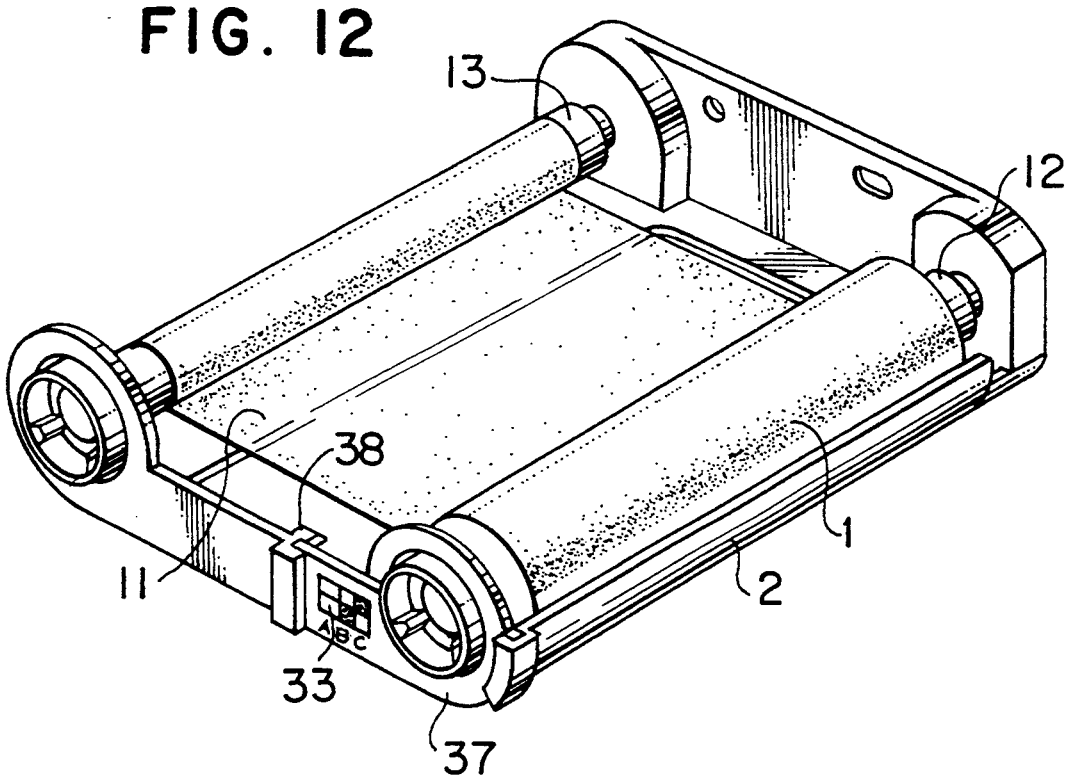
FIG. 12 is an oblique projection view of another embodiment of an ink-sheet roll assembly according to the present invention and a cartridge case on which the ink-sheet roll assembly is set.

As shown in FIG. 12, a support plate 37 with the indication portion 33 may be connected to the flange side end of the ink-sheet storing shaft 12 in a rotatable manner. The forward end of the ink-sheet storing shaft 12 is directly mounted on the cartridge case 2 in a rotatable manner. The flange side end of the ink-sheet storing shaft 12 is supported in a rotatable manner on the cartridge 2 case through the support plate 37 with the indication portion 33 for indicating the characteristic or kind of the ink-sheet 11 wound on the ink-sheet storing shaft 12. The support plate 37 is detachably fitted in a grooved portion 38 of the cartridge case 2 to be supported therein. In this case, the number of members to be exchanged on the replacement of the ink-sheet 11 is further reduced.

The ink-sheet storing shaft 12 and the ink-sheet take-up shaft 13 may be mounted on the cartridge case 2 by a lid which prevent the ink-sheet storing shaft 12 and the ink-sheet take-up shaft 13 from separating from the cartridge case 2.

The ink-sheet 11 may include the thermally fusible ink which is melted in the ink-sheet 11 by the heat energy of the thermal head to penetrate into the work sheet 5 or the vaporizable ink is vaporized from the ink-sheet 11 by the heat energy of the thermal head to penetrate into the work sheet 5. The ink-sheet 11 may includes an electrically conductive layer with an electric resistance over a surface thereof, and the thermally fusible or vaporizable ink is melted or vaporized to penetrate into the work sheet 5 by an electrode head for supplying an electricity to the electrically conductive layer to generate the heat energy thereon.

The cartridge case 2 may receive the ink-sheet roll assembly 1 or 6 before being used by an end-user, that is, a combination of the ink-sheet roll assembly 1 or 6 and the cartridge case 2 may be supplied to the end-user to reuse the cartridge case 2.

Figure 13:
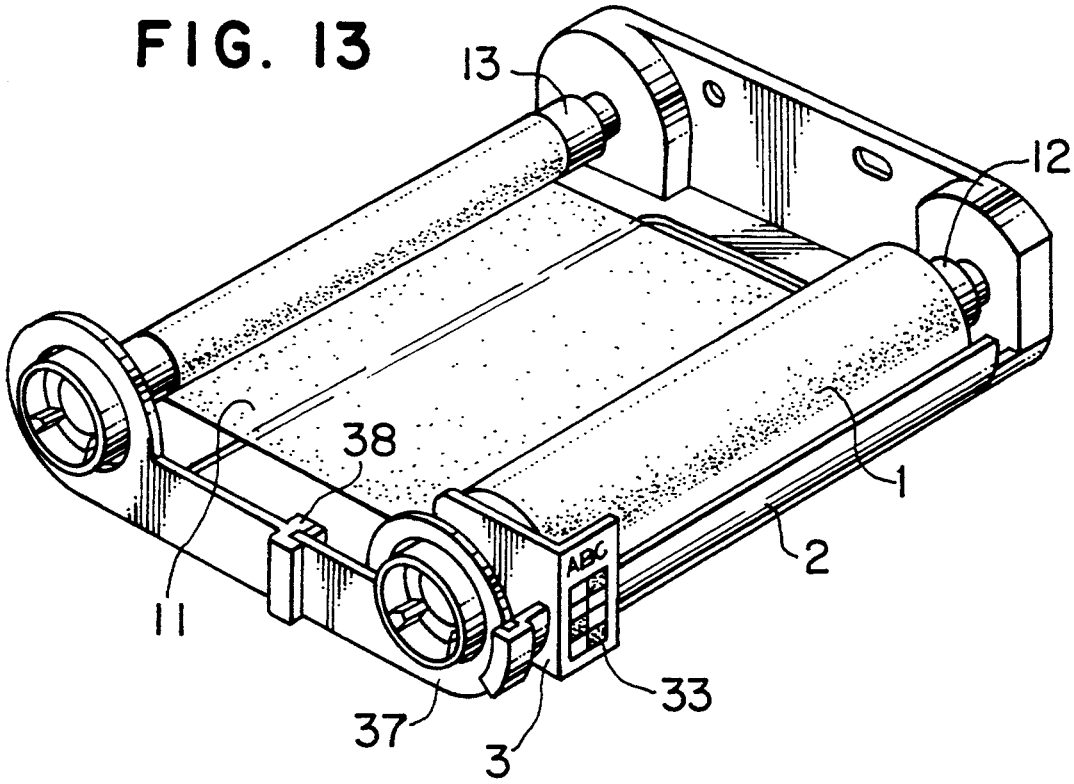
FIG. 13 is an oblique projection view of another embodiment of an ink-sheet roll assembly according to the present invention and a cartridge case on which the ink-sheet roll assembly is set.

As shown in FIG. 13, the support plate 37 without the indication portion 33 for indicating the characteristic or kind of the ink-sheet 11 wound on the ink-sheet storing shaft 12 may be connected to the flange side end of the ink sheet storing shaft 12 in a rotatable manner. The forward end of the ink-sheet storing shaft 12 is directly mounted on the cartridge case 2 in a rotatable manner. The flange side end of the ink-sheet storing shaft 12 is supported in a rotatable manner on the cartridge case 2 through the support plate 37. The support plate 37 is detachably fitted in a grooved portion 38 of the cartridge 2 to be supported therein. The indication portion 33 is arranged on the indicating member 33 which is mounted in a rotatable manner on the ink-sheet storing shaft 12 so that the indicating member 33 is supported on the cartridge case 2 through the ink-sheet storing shaft 12. Therefore, a combination of the ink-sheet storing shaft 12 and the indicating member 13 is detachably mounted on the cartridge case 2.

The forward end of the ink-sheet 11 may be fixed to the ink-sheet take-up shaft 13 after the ink-sheet storing shaft 12 and the ink-sheet take-up shaft 13 are mounted on the cartridge case 2.

What is claimed is:

1. Means for holding a thermal transfer printing ink-sheet in a cartridge case and for indicating a characteristic of the ink-sheet, comprising:

an ink-sheet including an ink which is transferred from the ink-sheet by heat energy, a shaft on which the ink-sheet is wound, said shaft being detachably and rotatably mounted in the cartridge case, and an indicating member separate from the cartridge case, indicates the characteristic of the ink-sheet, the indicating member being rotatably mounted with respect to the shaft to substantially prevent said indicating member from being rotated by said shaft, and said indicating member being connected to the shaft so that the indicating member and shaft are maintained as a unit on the cartridge case, and wherein the indicating member and the shaft are separable from the cartridge case upon the replacement of the ink-sheet.

2. Means according to claim 1, wherein the indicating member is mounted on the cartridge case through the shaft.

3. Means according to claim 1, wherein the shaft is mounted on the cartridge case through the indicating member.

4. Means according to claim 1, wherein the means further comprises a support member which is detachably mounted on the cartridge case and is rotatable relative to the shaft so that the shaft is mounted on the cartridge case through the support member, and the indicating member is mounted on the cartridge case through the shaft and the support member.

5. Means according to claim 1, wherein the indicating member is removably connected to the cartridge case.

6. Means according to claim 1, wherein the shaft is mounted on the cartridge case through the indicating member which is detachably mounted on the cartridge case.

7. Means according to claim 1, wherein the shaft includes a flange extending in a radial direction of the shaft, and the indicating member is received between the flange and the ink sheet wound on the shaft.

8. Means according to claim 1, wherein the indicating member extends radially outwardly of an outer periphery of the ink-sheet wound on the shaft.

9. Means according to claim 1, wherein the indicating member has a shaft receiving hole through which the indicating member is mounted on the shaft, and an inner diameter of the shaft receiving hole is smaller than a diameter of an outer periphery of the ink-sheet wound on the shaft so that the ink-sheet wound on the shaft restrains a movement of the indicating member on the shaft.

10. Means according to claim 1, wherein a part of the indicating member is received in the cartridge case.

11. Means according to claim 1, further comprising a take-up shaft for taking up the ink-sheet from the shaft.

12. Means according to claim 1, further comprising a take-up shaft for taking up the ink-sheet from the shaft, and wherein the indicator member holds the take-up shaft when the take-up shaft is not mounted in the cartridge case.

13. Means according to claim 1, wherein an end of the shaft is mounted on the cartridge case through the indicating member, and another end of the shaft is directly mounted on the cartridge case.

14. Means according to claim 1, further comprising a support member detachably mounted on the cartridge case and rotatable relative to the shaft so that an end of the shaft is mounted on the cartridge case to the support member, another end of the shaft is directly mounted on the cartridge case, and the indicator is mounted on the cartridge case through the shaft end of the support member.

15. Means according to claim 1, wherein both ends of the shaft are mounted on the cartridge case through the indicating member.

16. Means according to claim 1, wherein both ends of the shaft are mounted directly on the cartridge case.

17. Means according to claim 1, further comprising a support member detachably mounted on the cartridge case and rotatable with respect to the shaft so that the shaft is mounted in the cartridge case through the support member, and the indicating member is mounted on the cartridge case through the shaft member and the ink-sheet wound on the shaft.

18. Means for holding a thermal transfer printing ink-sheet and for indicating a characteristic of the ink-sheet, comprising:

a cartridge case, an ink-sheet including an ink which is transferred from the ink-sheet by heat energy, a shaft on which the ink-sheet is wound, said shaft being detachably and rotatably mounted on the cartridge case, and an indicating member, separate from the cartridge case, for indicating the characteristic of the ink-sheet, said indicating member being rotatable with respect to the shaft to substantially prevent said indicating member from being rotated by said shaft, and said indicating member being connected to the shaft so that the indicating member and the shaft are maintained as a unit on the cartridge case, and wherein the indicating member and shaft are separable from the cartridge case upon replacement of the ink-sheet.

* * * * *